United States Patent [19]

Dondi Benelli

[11] Patent Number: 4,458,730

[45] Date of Patent: Jul. 10, 1984

[54] LOOM WITH PNEUMATIC WEFT INSERTION

[75] Inventor: Dore Dondi Benelli, Borgo Ticino, Italy

[73] Assignee: Ergotron s.a.s. di Dondi Benelli Dore & C., Borgo Ticino, Italy

[21] Appl. No.: 358,776

[22] Filed: Mar. 17, 1982

[30] Foreign Application Priority Data

Mar. 26, 1981 [IT] Italy ..... 67422 A/81

[51] Int. Cl.[3] ..... D03D 47/30

[52] U.S. Cl. ..... 139/435; 139/190; 139/192

[58] Field of Search ..... 139/435, 188, 190, 192; 226/97

[56] References Cited

U.S. PATENT DOCUMENTS

| | | | |
|---|---|---|---|
| 503,457 | 8/1893 | Emery | 139/190 |
| 1,306,189 | 6/1919 | Pickstone | 139/192 |
| 3,399,701 | 9/1968 | Strake | 139/435 |
| 3,853,153 | 12/1974 | VanDuynhoven et al. | 139/435 |
| 4,319,611 | 3/1982 | Foltyn et al. | 139/435 |

*Primary Examiner*—Henry Jaudon

*Attorney, Agent, or Firm*—Sughrue, Mion, Zinn, Macpeak, and Seas

[57] ABSTRACT

The loom includes a reed constituted by a plurality of blades which are in alignment and parallel to each other. These blades have respective substantially circular apertures which have the same diameter and are aligned with each other to form a straight passage for guiding the pneumatic insertion of the weft. The portion of each blade between the aperture and the side of the blade facing the fabric (T), in use, has a substantially horizontal slit which extends from the aperture to the side of the blade. Between each pair of adjacent blades are interposed first and second spacer elements which are arranged respectively above and below the aperture and the slit of the blade. The loom includes drive means which, when activated, cause translational movement of the reed perpendicular to the longitudinal axis of the passage formed by the apertures in the blades of the reed.

8 Claims, 4 Drawing Figures

LOOM WITH PNEUMATIC WEFT INSERTION

The present invention relates to a loom with pneumatic weft insertion, including a reed provided with a plurality of blades which are in alignment and parallel to each other, for separating the warp threads, guide means for allowing the pneumatic projection of the weft through the warp shed, and drive means for displacing the reed along a path perpendicular to the weft to take the weft towards and/or press it against the woven fabric.

Looms with pneumatic weft insertion (also called jet looms) of the aforesaid type are known, and include a main reed for separating the warp threads, and an auxiliary reed between the main reed and the fabric. The auxiliary reed is formed by blades provided with apertures which are aligned so as to form a passage for guiding the pneumatic insertion of the weft. The main reed and the auxiliary reed are fixed to each other and, in operation, are rotated by the drive means of the machine in the direction of the fabric. During this rotation, the weft which is inserted into the warp shed leaves the auxiliary reed by passing through slits in the blades of the auxiliary reed. The weft is then "beaten" into the fabric by the main reed, in the final stage of the rotational movement.

Looms of the known type described above have various disadvantages. In the first place, they require the use of two reeds, main and auxiliary, in order to allow the insertion of the weft and the subsequent "beating". As a result of the presence of two reeds between the fabric and the healds, the warp shed of these looms has a considerable length and a considerable opening, in order to avoid, or at least to minimise as far as possible, the rubbing between the weft and the threads of the shed during "beating". Consequently, the main and auxiliary reeds must move through a considerable distance in order to effect beating. After beating, the healds change over. The fact that the width of the shed needs to be very large also results in the fact that the movement of the healds must be rather large. The considerable movement which the reeds and the healds must effect necessarily results in a low weaving rate in looms of this type.

Jet looms are also known which are provided with a single reed which acts as the guide for the insertion of the weft, and is rotated to effect the beating. Even in these looms the width of the warp shed is considerable in order to minimise the rubbing between the weft and the warp thread during beating. Moreover, in order to allow the formation of fabrics of considerable width, the reed must be provided with supplementary nozzles for introducing fluid under pressure into the passage which acts as the guide for insertion of the weft. The necessarily wide warp shed results in a low weaving rate. The presence of supplementary nozzles for inserting the weft results in a considerable consumption of fluid under pressure. This air consumption, together with the low rate of operation, make weaving on the looms less economic.

The problem of making a loom with pneumatic weft insertion which is simple and economic to manufacture, and which allows a fabric to be made at low cost and with high productivity, has not yet been resolved satisfactorily.

The object of the present invention is to provide a loom with pneumatic weft insertion, which avoids the disadvantages of prior art looms and resolves the aforesaid problem.

In order to achieve this object, the present invention provides a loom of the type specified above, the main characteristic of which lies in the fact that: the blades of the reed have respective substantially circular apertures of equal diameter which are aligned with each other so as to form a straight passage for guiding the weft; the portion of each blade between the aperture and that side of the blade facing the fabric, in use, has a substantially horizontal slit which extends from the aperture to said side of the blade; first and second spacer elements are interposed between each pair of adjacent blades and are disposed respectively above and below the apertures and slits of the blades, and in that the drive means are arranged to cause translational movement of the reed perpendicular to the longitudinal axis of the passage, when activated.

The structure of the reed of a loom according to the present invention allows it to operate with much shorter and narrower warp sheds than was possible with looms according to the prior art. Moreover, since the reed of the loom according to the invention effects a translational movement to carry out the "beating", it follows that the rubbing of the weft against the threads of the warp shed is practically negligible, notwithstanding the rather small dimensions of the shed.

Further characteristics and advantages of the loom according to the present invention will become apparent from the following detailed description, which is made with reference to the appended drawings provided purely by way of non-limiting example, in which.

Figure 1:
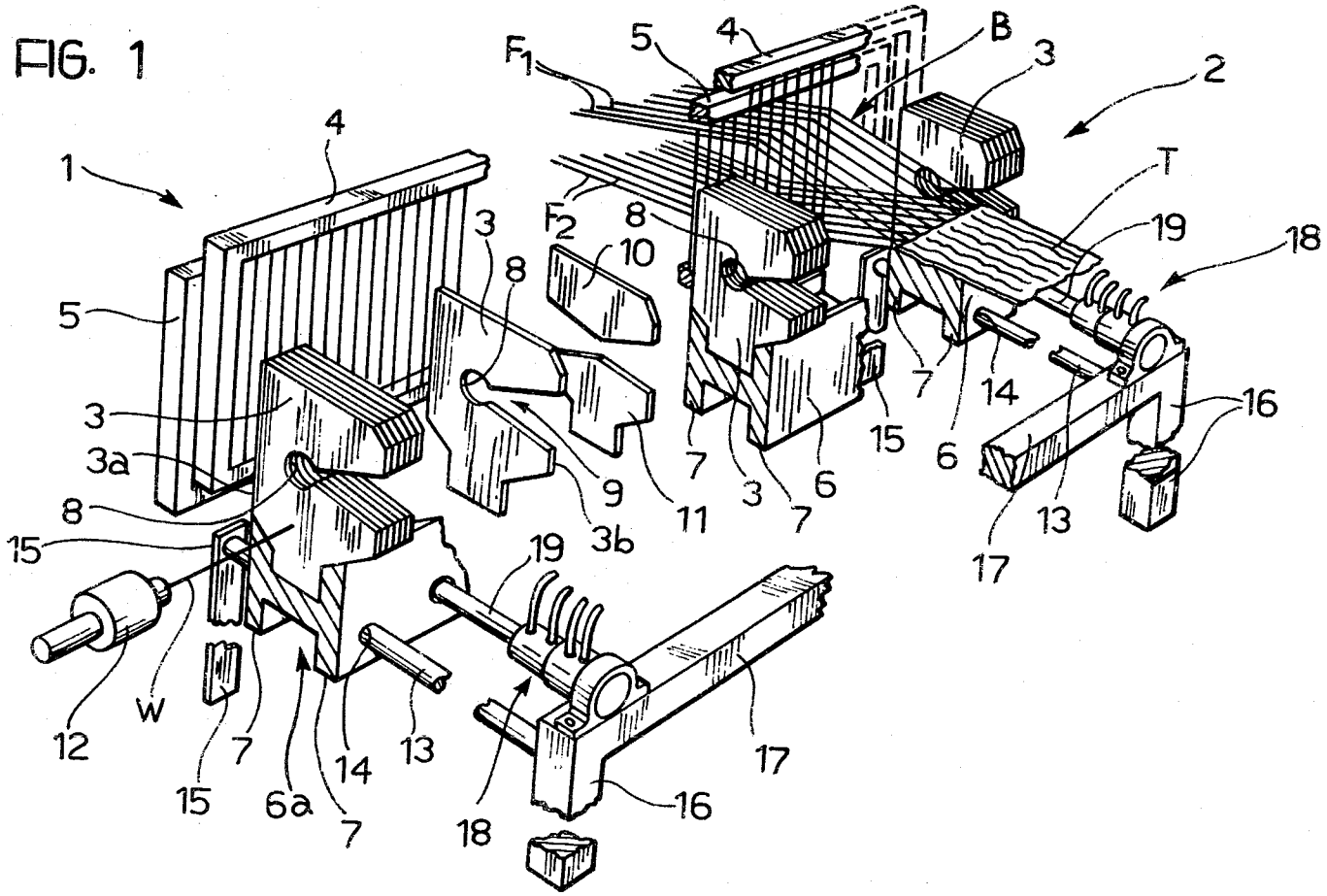
FIG. 1 is a partially-sectioned and exploded perspective view of part of a loom according to the present invention.

With reference to FIG. 1, a loom 1 according to the invention includes a reed 2 with a plurality of blades 3 which are in alignment and parallel to each other for separating the warp threads. These threads are divided into two weave rows $F_1$, $F_2$ by a pair of healds 4, 5 of conventional type.

The lower end portions of the blades 3 are fixed to a shaped support member 6. The lower face of this support member 6 has a longitudinal channel-sectioned groove 6*a* defined by two parallel facing walls, indicated 7 in FIG. 1.

Figure 2:
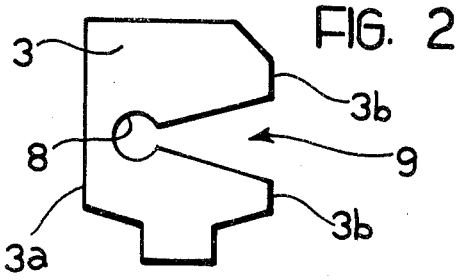
FIG. 2 is a side elevational view of a blade of the reed of the loom illustrated in FIG. 1.
Figure 4:
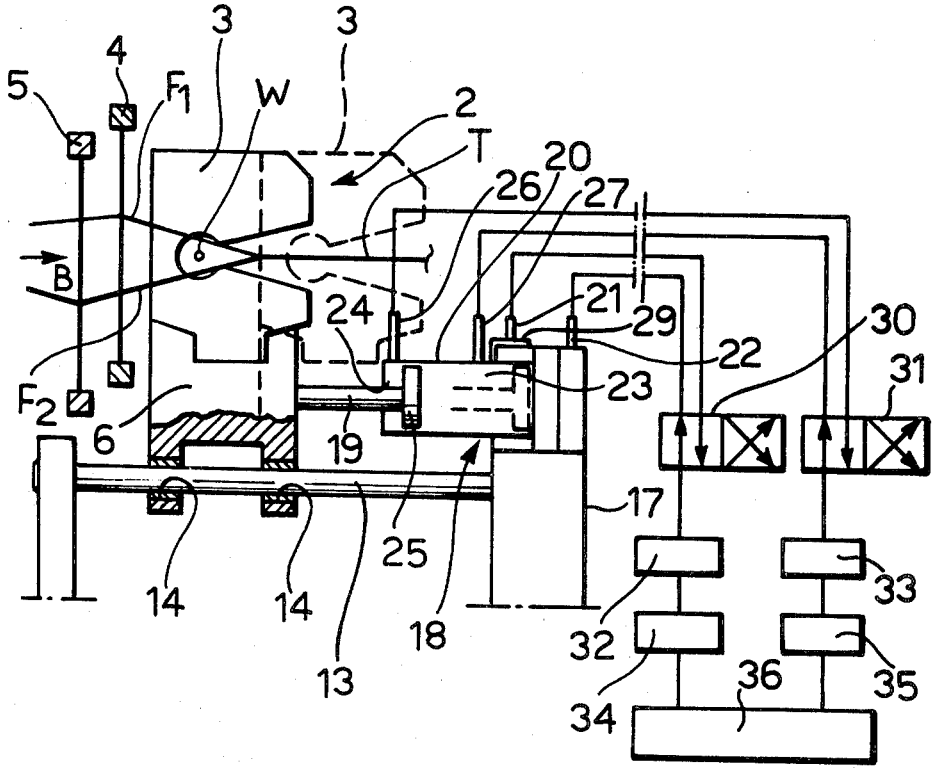
FIG. 4 is a side view of the loom of FIG. 1.

With reference to FIG. 2, each blade 3 of the reed 2 has a substantially circular aperture 8 close to its side 3*a* facing the healds 4, 5. The apertures 8 of the blades 3 are aligned with each other so as to form a straight passage intended to act as a guide for inserting the weft W in the warp shed B (FIGS. 1 and 4).

The portion of each blade 3 between the aperture 8 and the side 3*b* of the blade facing the fabric T, in use, has a slit 9 with a substantially horizontal longitudinal axis. The slit 9 of each blade 3 extends from the aperture 8 to the side 3*b* of the blade, becoming wider from the aperture 8 towards the side 3*b* of the respective blade 3. Preferably, the width of each slit 9 at the aperture 8 is less than the radius of the aperture 8.

First and second spacer elements 10, 11 are interposed between each pair of adjacent blades 3. Each spacer element 10 (FIG. 3) is interposed between two adjacent blades 3 above the aperture 8 and slit 9 of the blades.

Figure 3:
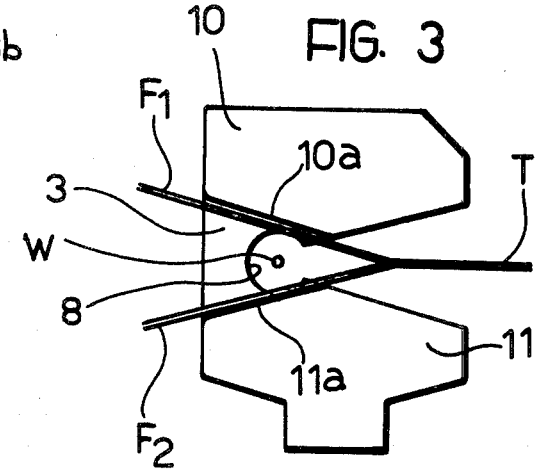
FIG. 3 is a side elevational view of a pair of spacer elements disposed between adjacent pairs of blades of the reed of the loom of FIG. 1.

Preferably, as illustrated in FIGS. 1 and 3, each spacer element 10 has a side 10*a* facing the aperture 8 of the blade, which is tangential to the upper edge of the aperture 8 and is parallel to the upper row $F_1$ of threads in the shed B.

Each spacer element 11 (FIG. 3), located between two adjacent blades 3, has a side 11*a* which is preferably tangential to the lower edge of the aperture 8 of the blade and is parallel to the lower row $F_2$ of threads in the shed.

A weft injector device 12 of conventional type, for propelling the weft W through the guide passage formed by the series of apertures 8 in the blades 3, is shown in FIG. 1.

The reed 2 is mounted for translation along two parallel horizontal guide bars 13 which pass through respective pairs of aligned holes 14 formed at the ends of the support 6 perpendicular to the walls 7 on its lower face.

Each of the guide bars 13 is supported at one end by an upright 15 and at the other end by a pillar 16. The upper ends of the pillars 16 are connected by a crossbar 17 extending parallel to the reed 2. Two pneumatic cylinders are fixed to the crossbar 17 with their respective rods 19 parallel to the guide bars 13 and connected at one end to the support 6 of the reed 2.

As shown in FIG. 4, each pneumatic cylinder 18 includes a main part 29 fixed to the crossbar 17, and a movable part 20 one end of which projects from the part 29. The part 29 and the movable part 20 constitutes a double-acting cylinder to which fluid under pressure may be feed through two inlet connectors 21, 22.

The movable part 20 has an internal chamber 23 with an aperture 24. A second movable member 25 is disposed within the chamber 23 and is provided with a rod which, projecting through the aperture 24 in the movable part 20, constitutes the rod 19 of the pneumatic cylinder, generally indicated 18. First and second connectors 26, 27 are arranged to supply fluid under pressure to the chamber 23 on opposite sides of the movable member 25. The movable part 20, and the member 25 displaceable in this movable part 20, constitute a second double-acting cylinder.

The pneumatic actuators, generally indicated 18, 19 constitute drive means arranged to cause the translational movement of the reed 2 along the guide bars 13, when activated.

As illustrated in FIG. 4, the connectors 21, 22, 26, 27 of the pneumatic actuators 18, 19 may be connected to two two-position two-way valves 30, 31. These valves 30, 31 are connected to respective pressure buffer accumulators 32, 33. These accumulators are connected, by respective pressure regulating devices 34, 35 of conventional type, to a compressor or main pressure accumulator 36.

The loom according to the invention operates in the following manner.

It is assumed that the reed 2 is initially in the position shown by solid lines in FIG. 4. In this position, the device 12 injects a weft W into the guide formed by the series of apertures 8 of the blades 3 by means of a high-pressure jet of air. The passage allows only very limited dispersion of the fluid. In fact, this dispersion may occur only through the slits 9 of the reed blades 3 and the lateral apertures between each pair of adjacent blades 3 defined by the lower sides of the spacer elements 10 and the upper sides of the spacer elements 11.

Once a weft M has been inserted, fluid under pressure is fed to the chamber 23 of the part 20 through the inlet connector 26. Consequently, the shaft 19 is displaced towards the right in FIG. 4, causing the translational movement of the reed 2 towards the fabric to effect so-called "beating" of the weft into the fabric T itself. When the reed 2 has reached the beating position, shown in broken outline in FIG. 4, fluid under pressure is fed to the inlet 27 of the chamber 23 and the shaft 19 is displaced towards the left, in FIG. 4, carrying the reed 2 to the starting position for the insertion of another weft. Once the starting position has been reached, the healds 4, 5 are operated by conventional means (not shown) to change the position of the rows $F_1$, $F_2$ of threads constituting the warp shed. The operation then starts again with the insertion of the new weft.

The pneumatic cylinders 18, 19 shown in FIGS. 1 and 4 allow the displacement and speed of displacement of the reed 2 along the guide bars 13 to be changed at each beating, when necessary. In effect, if pressure is fed simultaneously to the connectors 26, 21 during the beating movement, the shaft 19 is displaced further and faster towards the right (FIG. 4). The possibility of controlling the approach of the reed to the fabric in a different manner in each beating permits a variation in the types of fabric, for example, the so-called "terry" fabrics, made on a single type of loom.

It is possible to regulate the beating pressure of the reed according to the needs of the weaving, unlike any loom made previously.

Conveniently, the inlet/outlet connectors 21, 22, 26, 27 of the pneumatic cylinders 18 may be connected to a conventional type of pneumatic or electronic logic control unit which is suitably programmed to effect the weaving of different fabrics.

The loom 1 may be provided with heald control mechanisms of, for example, the Jacquard or dobby type. When pneumatic actuators 18, 19 are used, these may be governed by a programme carried out by the control mechanisms.

The structure of the reed 2 described above allows the weft to be inserted into very narrow or short warp sheds. This results in a smaller movement of the reed 2 to effect beating, and a smaller movement of the healds every time they change over the rows $F_1$, $F_2$ of threads forming the warp shed.

Notwithstanding the small warp shed, the rubbing of the weft against the threads of the shed is practically negligible due to the straight movement of the reed 2 during beating.

Thus, the loom according to the invention allows a greater productivity and, furthermore, its operation is characterised by less noise than conventional looms due to the use of pneumatic drive means.

A further advantage of the loom according to the invention lies in the fact that it is possible, by virtue of its "jerky" operation, to stop the operation at any stage.

I claim:

1. Loom for weaving a fabric having means for the pneumatic insertion of a weft, including a reed provided with a plurality of blades which are in spaced parallel alignment to each other, for receiving a plurality of warp threads therebetween, guide means for allowing the pneumatic projection of the weft through a warp shed, and drive means for displacing the reed along a path perpendicular to the weft to beat up the weft into the fell of the fabric, characterised in that: the blades of the reed have respective substantially circular apertures of equal diameter which are aligned with each other so as to form a straight passage to define said guide means for guiding the weft; the portion of each blade between the aperture and the side of blade facing the fabric has a substantially horizontal slit which extends from the aperture to said side of the blade; first and second spacer elements are interposed between each pair of adjacent blades and are disposed respectively above and below the apertures and slits of the blades of each pair of adjacent blades, and the drive means are arranged to cause translational movement of the reed perpendicular to the longitudinal axis of the passage when activated.

2. Loom according to claim 1, characterised in that the slit of each blade of the reed increases in width progressively from the aperture of the blade towards the side of the blade facing the fabric.

3. Loom according to claim 2, characterised in that, at the aperture of the blade, the width of the slit of each blade of the reed is less than the radius of the aperture.

4. Loom according to claims 1, 2, or 3, characterised in that the respective sides of the first and second spacer elements facing the apertures of the blades are tangential to the upper and lower edges of the apertures respectively, and are parallel to the upper and lower rows of threads of the warp shed respectively.

5. Loom according to claim 4, characterised in that the reed is mounted for translation along a straight guide perpendicular to the guide passage for the weft.

6. Loom according to claim 5, characterised in that said loom is further provided with regulating means which are connected to the drive means to regulate the beating pressure of the reed.

7. Loom according to claim 6, characterised in that the drive means include at least one first and one second double-acting pneumatic cylinder having respective parts connected to the structure of the loom between the reed and the fabric and respective movable members fixed to the reed.

8. Loom according to claim 7, characterised in that parts of the first and second pneumatic cylinders respectively constitute movable members of third and fourth pneumatic cylinders having respective parts fixed to the structure of the loom to allow the reed to approach the fabric in a different manner at each beating.

* * * * *